United States Patent [19]

Mizelle

[11] Patent Number: 4,813,743

[45] Date of Patent: Mar. 21, 1989

[54] RECLINING BACK MECHANISM FOR A SEATING UNIT

[76] Inventor: Ned W. Mizelle, P.O. Box 5985, High Point, N.C. 27262

[21] Appl. No.: 67,826

[22] Filed: Jun. 30, 1987

[51] Int. Cl.[4] ..... A47C 15/00

[52] U.S. Cl. ..... 297/357; 297/301

[58] Field of Search ..... 297/355, 354, 361, 301, 297/355

[56] References Cited

U.S. PATENT DOCUMENTS

| | | | |
|---|---|---|---|
| 334,087 | 1/1986 | Price | 297/285 |
| 1,774,098 | 8/1930 | Hickman | 297/308 |
| 3,295,885 | 1/1967 | Barksdale | 297/84 |
| 3,383,135 | 5/1968 | Posh | 297/355 |
| 3,398,986 | 8/1968 | Homier | 297/355 |
| 3,471,140 | 10/1969 | Ballard | 267/1 |
| 3,880,465 | 4/1975 | Scheben | 297/345 |
| 3,930,565 | 1/1976 | Scheben et al. | 188/300 |
| 3,963,101 | 6/1976 | Stadelmann et al. | 188/300 |
| 4,072,288 | 2/1978 | Wirges et al. | 248/404 |
| 4,139,175 | 2/1979 | Bauer | 248/404 |
| 4,183,689 | 1/1980 | Wirges et al. | 403/31 |
| 4,245,826 | 1/1981 | Wirges | 267/131 |
| 4,257,582 | 3/1981 | Wirges | 267/120 |
| 4,353,594 | 10/1982 | Lowe | 297/355 X |
| 4,386,803 | 6/1983 | Gilderbloom | 297/84 |
| 4,533,177 | 8/1965 | Latone | 297/301 |

FOREIGN PATENT DOCUMENTS

| | | | |
|---|---|---|---|
| 3239356 | 4/1984 | Fed. Rep. of Germany | 297/355 |
| 3325798 | 1/1985 | Fed. Rep. of Germany | 297/355 |

*Primary Examiner*—James T. McCall

*Attorney, Agent, or Firm*—Beveridge, DeGrandi & Weilacher

[57] ABSTRACT

A chair or sofa has a reclining back connected to a base by a mechanism which has a user-lockable, vertically oriented gas spring mounted behind the seat surface. The upper and lower ends of the gas spring are connected to upper and lower transverse members which are, in turn, connected to mounting plates on the back and base of the chair or sofa. The mounting plates are pivotally interconnected to provide reclining movement of the back.

11 Claims, 5 Drawing Sheets

RECLINING BACK MECHANISM FOR A SEATING UNIT

BACKGROUND OF THE INVENTION

This invention relates to an improved mechanism for connecting a reclining back to the base of a piece of furniture such as a chair or sofa, such furniture pieces being referred to herein generally as seating units.

Modern recliners and incliners have mechanisms which often produce interdependent seat, back and legrest movements. These mechanisms are relatively complicated and to some extent they impose constraints on furniture designers as to the configuration of the furniture unit, the type of suspension which can be used in the seat portion of the unit, and the nature of the legrest extension mechanism.

The present invention pertains to a reclining back mechanism which does not provide and is entirely independent from any seat or legrest mechanisms. Significantly, the mechanism of the invention is constructed so that it is completely located only in the back area of the seating unit, thus giving the furniture designer a great deal of freedom as to the nature of the seat structure, legrest mechanism or seat suspension.

SUMMARY OF THE INVENTION

A reclining back mechanism has a pair of stationary mounting plates which are substantially parallel and vertical and are connectible to the stationary base of a seating unit. A pair of swinging mounting plates are pivotally supported by the stationary mounting plates. These swinging mounting plates constitute a movable portion of the mechanism, and they are connectible to the reclining back of the seating unit. To control the relative movement between the stationary plates and swinging plates, the mechanism has a generally vertical extensible means which is entirely located rearwardly of the pivots of the mounting plates. The extensible means has a lower end connected to at least one stationary mounting plate and an upper end which is connected to at least one movable mounting plate. Within the extensible means there is a chamber which contains a fluid and is provided with a valve for controlling the fluid flow to and from the chamber. The valve is movable to and from a back-locking position which prevents the fluid from flowing to or from the chamber. While in its back-locking position, the valve prevents movement between the movable and stationary portions of the reclining back mechanism in order to hold the back at an inclination selected by the user. A user-operable actuator is provided for operating the valve.

DETAILED DESCRIPTION

Figure 1:
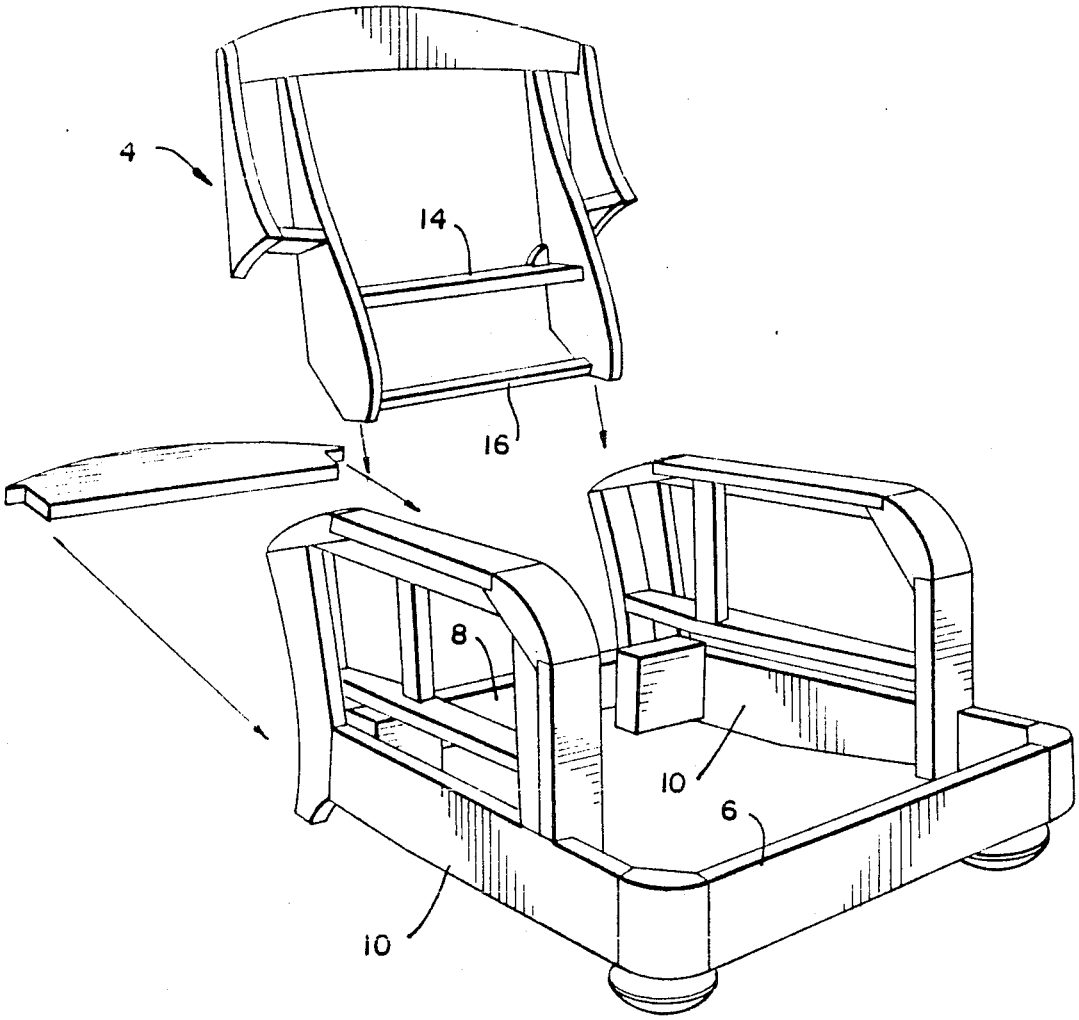
FIG. 1 is a somewhat diagrammatic exploded view of a chair frame with which the mechanism of the invention is used.

Referring to FIG. 1, it will be seen that the chair frame has a stationary base 2 and a reclining back 4. The base has a front 6, a back 8, and two sides 10. The back 4 has crossrails 14 and 16, and two vertical sides 18 to which the mechanism is attached. In a usual manner, the base 2 and reclining back are provided with springs, cushioning material and upholstery fabrics, and they also may be provided with additional mechanisms which may, for example, add an extensible legrest to the unit.

The mechanism includes two mirror image sides, which have stationary mounting plates 22 and pivoted portions 24 which lie in parallel substantially vertical planes. The plates 22 are connectible to the sides 10 of the base 2. Each movable portion 24 is connectible to a side 18 of the reclining back of the seating unit. The swinging plate 24 is connected by pivot means 26 to the stationary mounting plate 22 so that the swinging mounting plate is supported by the stationary mounting plate. The connections of members 22 and 24 to the base 2 and back 4 may be made with T-nuts or any other suitable fasteners which are well known in the furniture manufacturing industry. The mounting plate 22 is L-shaped, and the swinging plate 24 is oriented so that the members 22 and 24 together form a generally C-shaped assembly.

Figure 2:
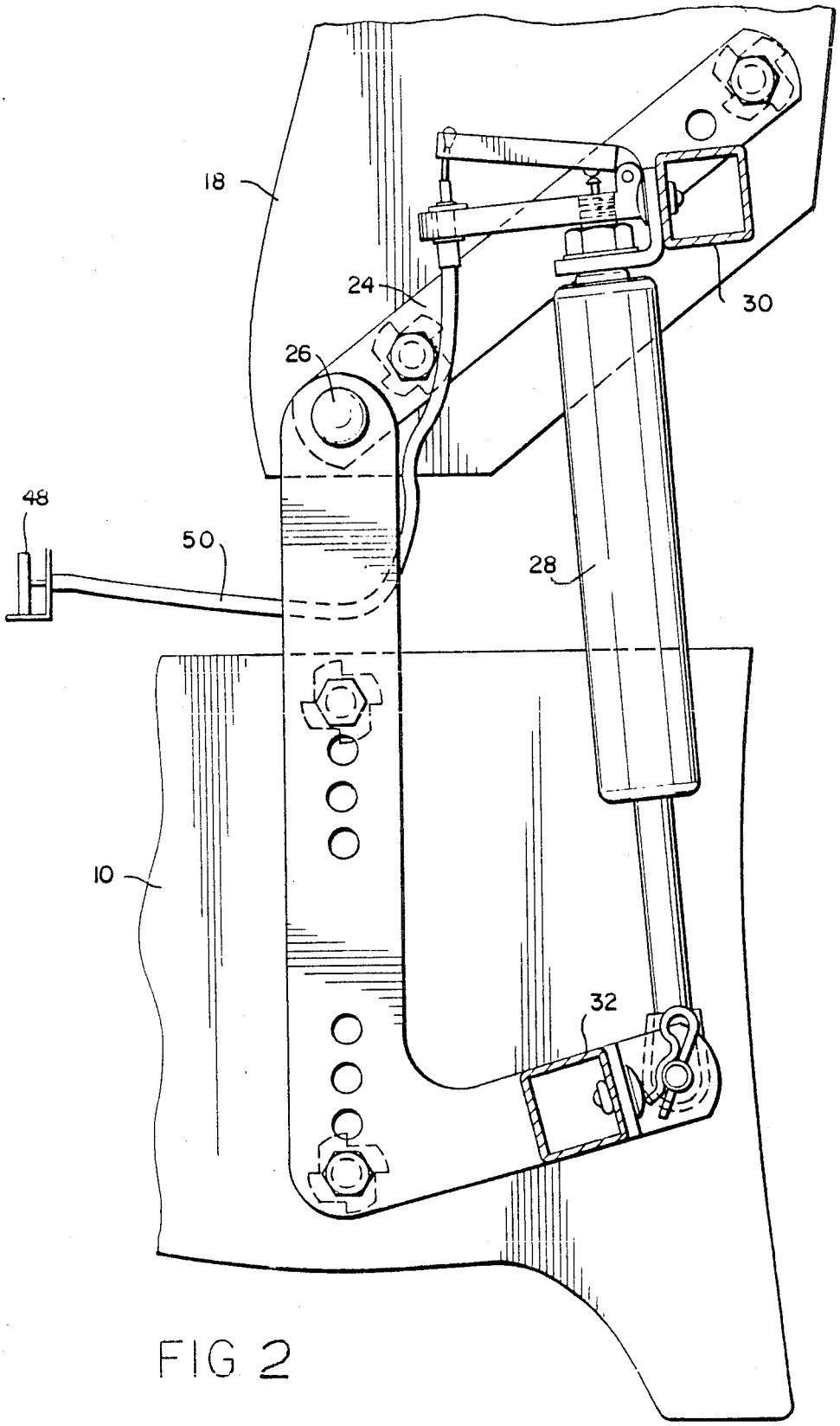
FIG. 2 is a partial side elevation of the chair frame of FIG. 1 with a back reclining mechanism installed therein.

An internally lockable gas spring unit 28 is an extensible means which has its opposite ends indirectly connected between the stationary mounting plates and the swinging mounting plates. This indirect connection is made via an upper transverse bar 30 and a lower transverse bar 32. The opposite ends of the upper transverse bar 30 are connected by brackets to the swinging mounting plates 24, and the lower transverse bar 32 has its opposite ends connected by brackets to the stationary mounting plates 22. The gas spring is located midway between the opposite ends of the transverse bars 30 and 32. It has its upper end connected by a bracket to the midportion of the upper transverse bar 30, while its lower end is connected by a bracket to the center of the lower transverse bar 32. As can be seen in FIG. 2, any pivotal movement of the swinging mounting plates 24 relative to the stationary mounting plates 22 will result in an effective change of length of the gas spring. In this respect, the gas spring serves as an extensible means which has its lower end connected to at least one of the stationary mounting plates and its upper end connected to at least one of the swinging mounting plates. This gas spring is oriented generally vertically and, as shown in FIG. 2, it is entirely located rearwardly of the pivots 26.

Figure 3:
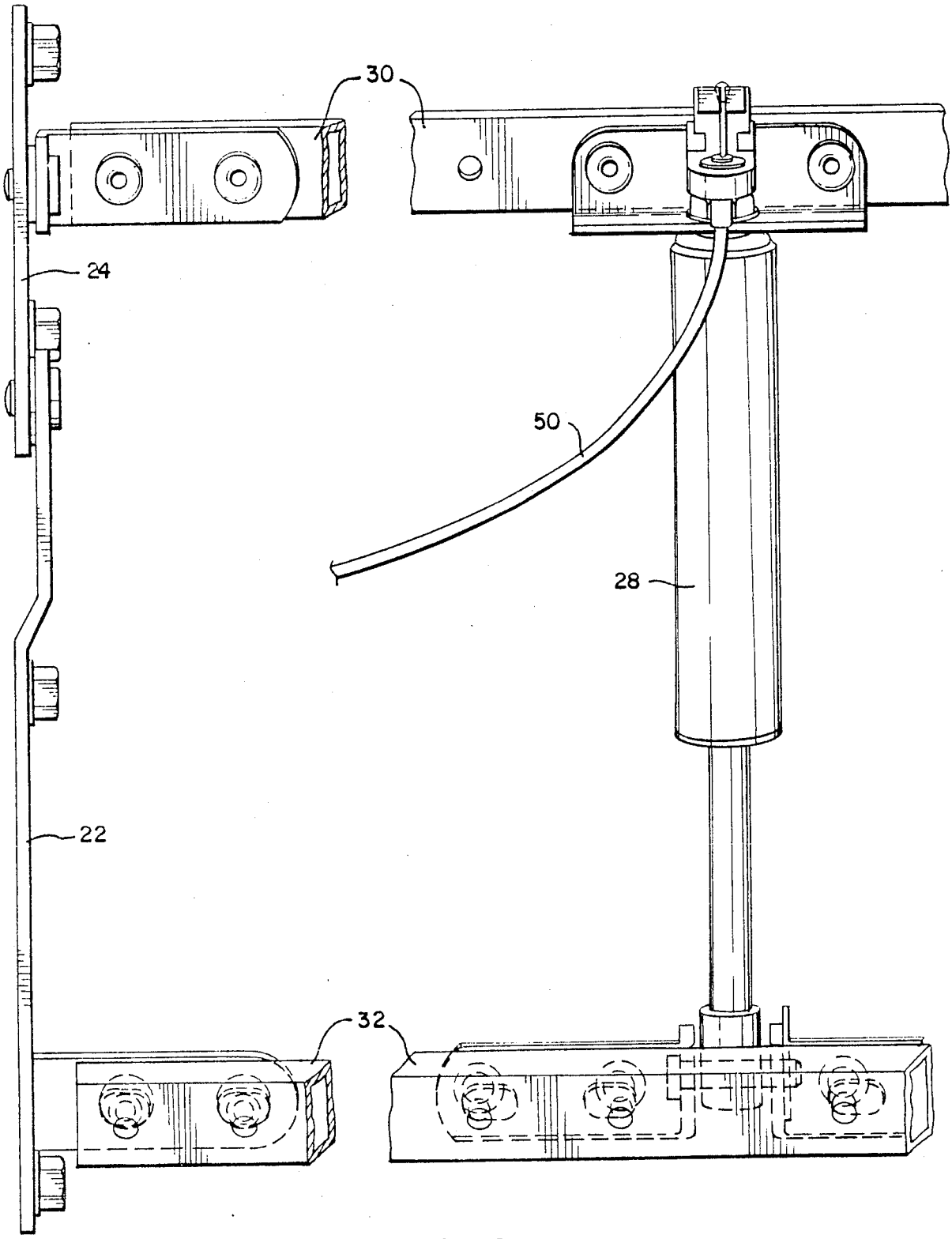
FIG. 3 is a partial front elevation of the mechanism of FIG. 2.
Figure 4:
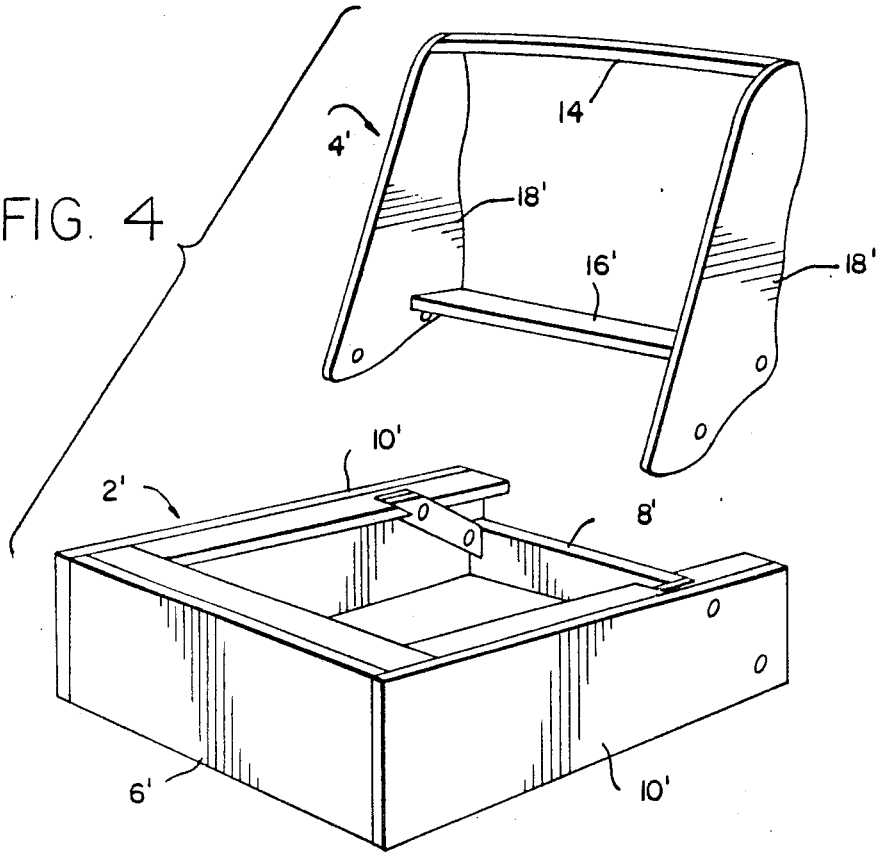
FIG. 4 is an exploded view of another chair frame which may be used with, the mechanism of the invention.
Figure 5:
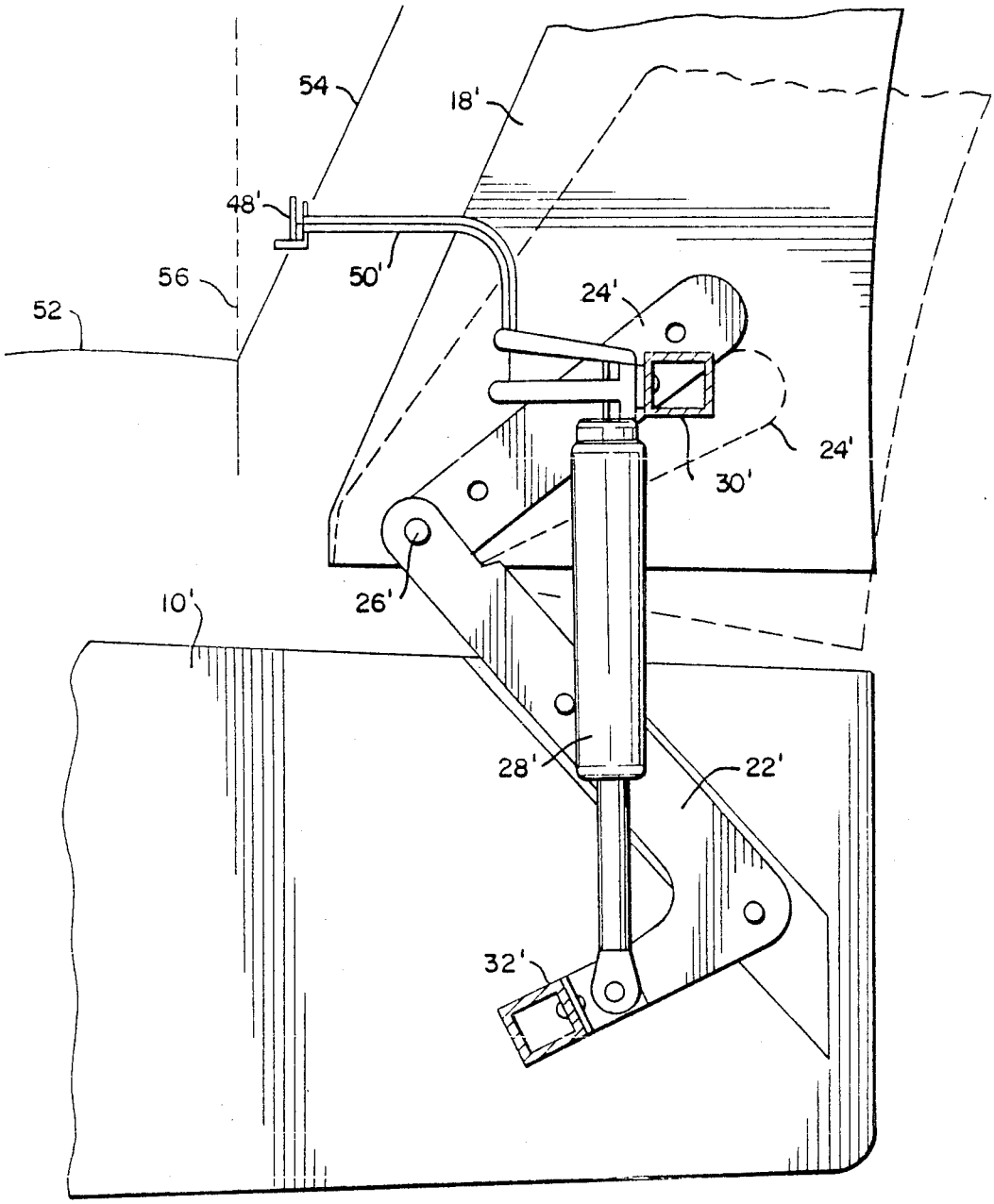
FIG. 5 is a partial side elevation showing the configuration of the mechanism when it is installed on a chair frame of the type shown in FIG. 4.

A different type of chair frame and a different configuration of the mechanism are shown in FIGS. 4 and 5. Primed reference numerals are used in these drawings to identify elements which correspond to elements shown in FIGS. 1–3. A principal difference between these two examples is in the orientation of the members 22 and 22'. As shown in FIG. 4, this member 22' has been reversed so that its foot extends at a downward and forward inclination. The member 24' is disposed so that the members 22' and 24' form a somewhat Z-shaped linkage.

Figure 6:
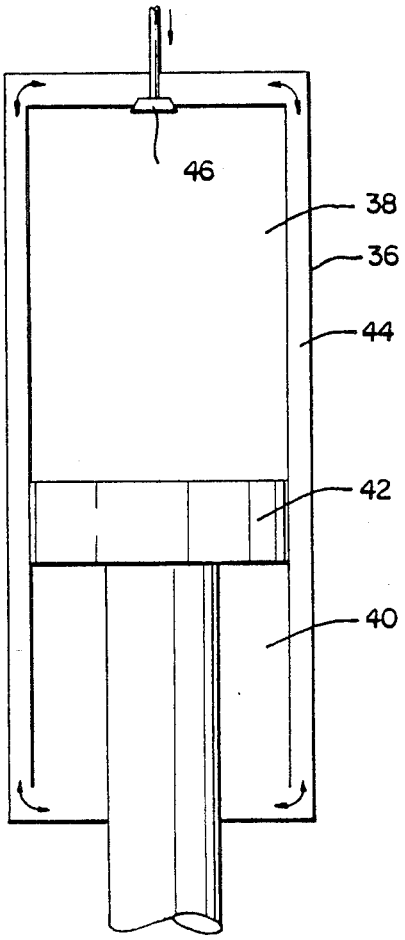
FIG. 6 is a diagrammatic view showing the principle of operation of a lockable gas spring used with the invention.

The principle of operation of the gas spring unit can be seen in FIG. 6. The cylinder 36 has an upper chamber 38 and a lower chamber 40 which are located respectively above and below the piston 42. Fluids at above-atmospheric pressures are in the chambers 38 and 40.

Preferably both a liquid and a pressurized gas are in the unit. Relative axial movement between the piston 42 and cylinder 36 changes the volumes of the chambers 38 and 40. The cylinder has a double wall which, in effect, provides a passage 44 for fluid which can move between the chambers 38 and 40. Such flow, however, is selectively preventable by means of a valve 46 which is located in the upper chamber. This valve is movable to and from a back-locking position, i.e. a closed position, which prevents the fluid from flowing to or from either chamber. Accordingly, it will be understood that while the valve is in its closed back-locking position, movement between the movable and stationary portions of the reclining back mechanism are prevented, thereby holding the back at an inclination selected by a user.

The gas spring mechanism may take many forms. Such devices are well known in the furniture industry for purposes of seat height and back adjustments. However, when used for back adjustments, a near-horizontal orientation has been used in the art. Various suitable gas springs are shown in the United States patent issued to Stabilus GmbH as assignee, and these patents are incorporated herein by reference.

The valve in the gas spring unit is operated by means of an external lever, one of which is designated 48 in FIG. 3. Connected to this lever, there is an actuator cable 50 which is Boden wire device having an internal wire surrounded by an external conduit. The manually actuatable lever 48 is connected to the wire and it is mounted on the seating unit where it is convenient to a user. The wire-enclosing conduit has its opposite ends connected to the lever support 52 and a member 54 on the gas spring unit. Thus, by moving the lever 48, the valve in the gas spring is moved between its open and closed positions in order to permit selective locking of the back at an inclination which is comfortable for the individual user. When the back is reclined, displacement of the piston rod increases the pressure and, when the valve is released, the increased pressure is used to return the back to its upright position.

As shown in FIGS. 2 and 5, the entire mechanism is located where it is spaced from any seat spring unit or legrest mechanism in the chair. This gives a furniture designer complete freedom in selecting seat spring units and legrest mechanisms. The unit is concealed entirely beneath and behind the exposed exterior seat surface and back surface of the chair which are illustrate by the lines 52 and 54 in FIG. 5. The mechanism is located entirely rearwardly of the vertical plane 56 where the seat surface intersects the back surface.

Persons familiar with the field of the invention will realize that it may be practiced by various devices which are different from the specific illustrated embodiment. Therefore, it is emphasized that the invention is not limited only to this embodiment but is embracing of a wide variety of mechanisms which fall within the spirit of the following claims.

I claim:

1. A reclining back mechanism for a seating unit which has a stationary base and a reclining back, said stationary base having opposed side members, said reclining back having opposed side members, said mechanism including a stationary portion which is connectible to the stationary base of the seating unit, said mechanism including a movable portion which is connectible to the reclining back of the seating unit, said stationary portion of the mechanism including a pair of stationary mounting plates which lie in parallel planes which are substantially vertical, said stationary mounting plates being provided with fastener-receiving means for receiving fasteners which attach the stationary mounting plates to the side members of the stationary base of the seating unit, said movable portion of the mechanism including a pair of swinging mounting plates which are connectible to the reclining back of the seating unit, said swinging mounting plates being connected by pivot means to and supported by the stationary mounting plates, said swinging mounting plates being provided with fastener-receiving means for receiving fasteners which attach the swinging mounting plates to the side members of the reclining back of the seating unit, an extensible means which has a lower end connected to at least one said stationary mounting plate and an upper end connected to at least one said movable mounting plate, said extensible means having a chamber which contains a fluid and also having a valve for controlling the flow of said fluid to and from said chamber, said valve being movable to and from a back-locking position which prevents the fluid from flowing to or from the chamber, said valve while in said back-locking position preventing movement between the movable and stationary portions of the reclining back mechanism so as to hold the back at an inclination selected by a user, and a user-operable actuator for operating said valve, said extensible means being oriented generally vertically and being entirely located rearwardly of said pivot means.

2. A reclining back mechanism according to claim 1 including a lower transverse member connecting the lower end of the extensible means to both said stationary mounting plates of the mechanism, and an upper transverse member connecting the upper end of the extensible means to both of said swinging mounting plates of the mechanism.

3. A reclining back mechanism according to claim 1 wherein the extensible means is a gas spring.

4. A reclining back mechanism according to claim 1 wherein the mechanism is in a seating unit which has a stationary base and a reclining back, said seating unit having exposed surfaces which include an upwardly facing seat surface and a forwardly facing back surface, said mechanism being concealed entirely by said exposed surfaces.

5. A reclining back mechanism according to claim 4 wherein the mechanism is located entirely rearwardly of a vertical plane where said seat surface intersects said back surface.

6. A reclining back mechanism according to claim 1 wherein said actuator includes a remote control cable which has one end operatively connected to said valve.

7. A reclining back mechanism according to claim 1 including a lower transverse member connecting the lower end of the extensible means to both said stationary mounting plates of the mechanism, and an upper transverse member connecting the upper end of the extensible means to both of said swinging mounting plates of the mechanism, said extensible being located about midway between the ends of said upper and lower transverse members.

8. A reclining back mechanism according to claim 7 wherein the extensible means is a gas spring.

9. A reclining back mechanism according to claim 7 wherein said actuator includes a remote control cable which has one end operatively connected to said valve.

10. A reclining back mechanism according to claim 7 wherein the mechanism is in a seating unit which has a stationary base and a reclining back, said seating unit having exposed surfaces which include an upwardly facing seat surface and a forwardly facing back surface, said mechanism being concealed entirely by said exposed surfaces.

11. A reclining back mechanism according to claim 10 wherein the mechanism is located entirely rearwardly of a vertical plane where said seat surface intersects said back surface.

* * * * *